United States Patent [19]

Bezek

[11] Patent Number: 4,998,365

[45] Date of Patent: Mar. 12, 1991

[54] SEGMENTED NEON DISPLAY

[75] Inventor: Donald J. Bezek, LaGrange, Ill.

[73] Assignee: Kazor Systems Inc., LaGrande, Ill.

[21] Appl. No.: 421,089

[22] Filed: Oct. 13, 1989

[51] Int. Cl.[5] ..... G09F 13/26

[52] U.S. Cl. ..... 40/545; 40/451

[58] Field of Search ..... 40/545, 550, 551, 552, 40/451; 379/102

[56] References Cited

U.S. PATENT DOCUMENTS

| | | | |
|---|---|---|---|
| 1,943,772 | 1/1934 | Prouty | 40/545 |
| 3,550,298 | 12/1970 | O'Neill | 40/545 |
| 4,491,690 | 1/1985 | Daley | 379/102 X |

FOREIGN PATENT DOCUMENTS

| | | | |
|---|---|---|---|
| 1204372 | 9/1970 | United Kingdom | 40/552 |

*Primary Examiner*—Kenneth J. Dorner
*Assistant Examiner*—J. Bonifanti
*Attorney, Agent, or Firm*—Hill, Van Santen, Steadman & Simpson

[57] ABSTRACT

A neon light display comprising seven segment modules of neon light tubes, and/or other segment configuration modules for special use. The neon light tubes comprise a serpentine configuration comprising a multi-row continuous tube. The serpentine configuration provides for improved visibility at night and at great distances. The modules are detachably secured to a housing which protects electric equipment such as transformers, inside a weather resistant structure. The modules are configured for efficient replacement, replacing an entire module rather than repairing individual segments in the field. The modules are screwed to a pair of rails and utilize high voltage plugs for electrical disconnection.

25 Claims, 2 Drawing Sheets

SEGMENTED NEON DISPLAY

BACKGROUND OF THE INVENTION

Field of the Invention

The present invention relates to neon signs, more particularly to neon displays for bill boards, road signs, airport signal displays and the like. Neon signs using seven tube segments for selectively displaying numbers and letters are known. The seven segments are utilized in various combinations to display English letters and numerals, to communicate a message. U.S. Pat. No. 1,906,960 to Harris discloses a neon sign comprised of a number of segments which permits a full range of letters to be displayed by selecting appropriate segments of the display. U.S. Pat. No. 1,965,874 discloses a segmented neon display having a full range of numerals which are displayed by energizing selected segments.

Prior art neon segment displays disclose neon tube segments comprising a single tube span configuration. This arrangement provides for limited visibility as compared to the present invention, especially when viewed from a substantial distance or viewed at night. Additionally, the present invention provides a modular concept for the segmented displays to facilitate replacing displays which experience failure of tube segments or for modifying the display apparatus. Such a modular design of segment type alpha-numeric neon displays for easy replacement of an entire seven segment module is not known to the art.

SUMMARY OF THE INVENTION

The present invention relates to neon signs, especially neon tube segment type displays for advertising displays, signs and the like.

It is an object of the present invention to provide a neon display that:

provides a uniquely visible display, especially visible at night or at great distance, or in rain or fog conditions;

provides for ease of maintenance and minimal repair time in the field;

provides for communicating a wide range of figures;

provides for a rugged construction; and provides for a compact cabinet arrangement, protecting electric equipment and the neon segments from weather and vandalism.

The object is inventively achieved in that the display provides:

display modules each providing a seven segment display configuration to display alpha-numeric figures, or providing other configurations such as a straight shaped configuration for forming the figure "1" and/or a square shaped configuration for forming a figure ".";

a display segment providing a neon tube of a serpentine configuration, and surrounding shield plates provides a much enhanced visibility over single tube configurations;

a quick installation and removal rack arrangement which provides a convenient means of attachment of the modules to the sign and reduces down time of maintaining the display by providing a method of replacing an entire module with a different module and returning the removed module to the shop for repair or to inventory for later use; and a housing providing an enclosed interior behind the modules for mounting electrical equipment therein, such as transformers, and providing a lens which covers the tube segments, both providing protection against weather and vandalism.

DESCRIPTION OF THE PREFERRED EMBODIMENT

Figure 1:
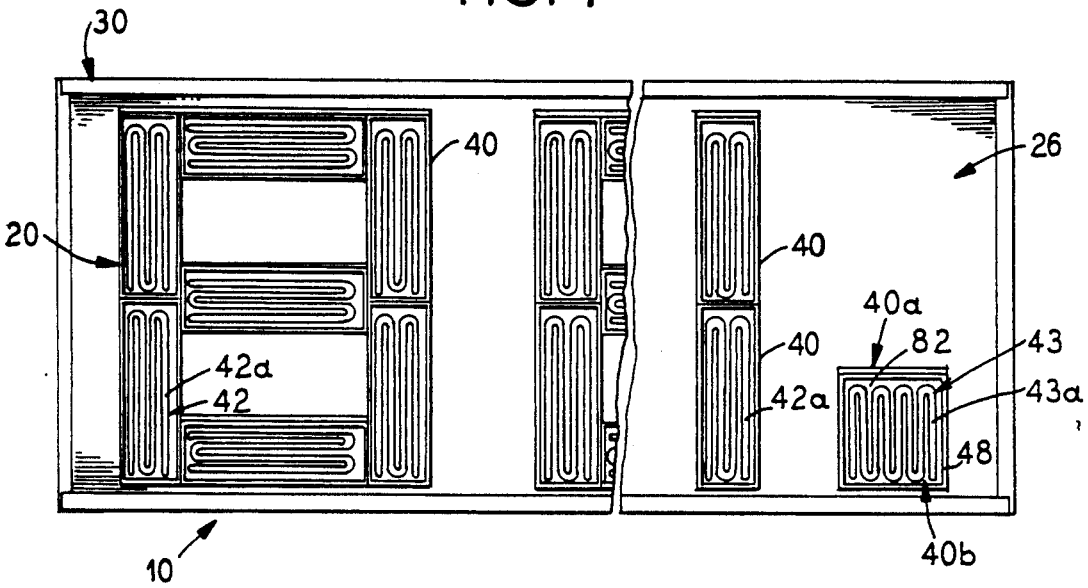
FIG. 1 is a front elevation view of a neon sign embodying the principle the present invention.

FIG. 1 shows a neon sign generally at 10 comprising a plurality of seven segment neon displays or modules 20 and an example of a three segment alternate display or alternate module 26. The modules 20, 26 are mounted to a housing 30. Although only two complete modules 20, 26 are indicated, a plurality of modules 20 as well as alternate modules 26 (if desired) are normally used to indicate words, prices, or other messages. It should also be understood that other alternate modules having segments configured other than that shown in FIG. 1 could be used to display function, percentages, non-numeric symbols, etc. as are known in the signage art.

The seven segment module 20 comprises seven neon segments 40 arranged in a figure 8 configuration. Such a configuration provides for a multitude of alpha numeric symbols when particular neon segments 40 are selectively charged or excited. The neon segments 40 are generally rectangular comprising a serpentine tube 42 coiled into four closely space apart parallel spans **42*a*, shown best in FIG. 3. The alternate module 26 illustrated provides for a commonly encountered arrangement in neon advertising: a symbol "1" followed closely by a decimal point. The "1" is formed with two neon segments 40 arranged lengthwise vertically and end to end. The decimal point is created by a square segment 40*a* comprising a coiled tube 43 coiled into eight closely spaced apart parallel portions 43*a*, substantially filling the square segment 40*a*. This alternate module 26 is used for example, to display a gallon price of gasoline. The modules 20 and 26 can be made in any desired size in order to adequately display a message at the placement location of the housing 30**.

Figure 2:
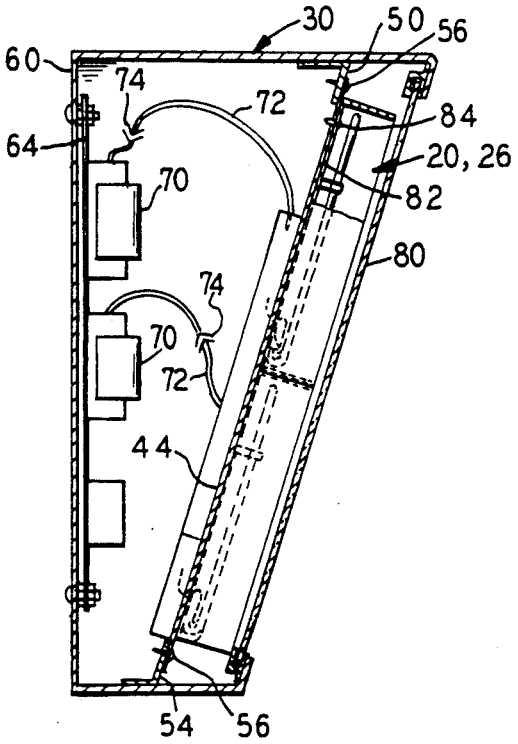
FIG. 2 is a left side end view of the neon sign of FIG. 1.

FIG. 2 shows the modules 20, 26 mounted inside the housing 30 by attachment of panels 44 to mounting rails 50, 54. The mounting rails 50, 54 are fixed to the housing 30 and arranged horizontally near a top and bottom of the housing 30. The seven segment module 20, and the alternate module 26 can be secured using bolts or screws 56. Each module 20 or alternate module 26 comprises one panel 44, providing individual removability of each module 20, 26. At a rear of the housing 30 is a back plate 60 whereon is mounted a chassis 64, which holds electrical transformers 70. The transformers 70 separately provide high voltage electrical power to the individual neon segments **40, 40*a*. High voltage electrical power may be provided by sources other than transformers as well. Power is transmitted to the neon segments 40, 40***a* via power cables 72 connected by means of a disconnect plug 74. At a front side of the housing 30 mounts a lens 80 which covers the modules 20, 26 translucently or transparently, protects the neon elements from weather and vandalism, and can modify the appearance of light from the modules 20, 26 transmitting therethrough.

Figure 3:
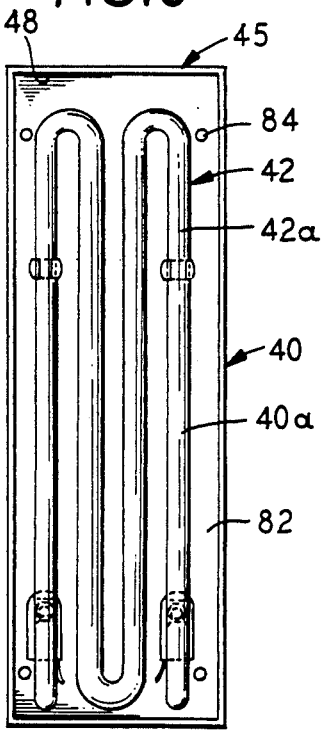
FIG. 3 is an enlarged front elevation view of a neon tube segment as shown in FIG. 1.

FIG. 3 shows the neon segment 40 as being comprised of a serpentine tube 42 mounted to a pan 45. The serpentine tube 42 comprises the four parallel spans 42*a*. The pan 45 is generally rectangular and includes a flat back wall 82 which is secured to the panel 44 by appropriate fastening means such as screws 84 and which is surrounded by upstanding side walls 48. The pan 45 with the upstanding side walls 48 forms a shallow open box around the serpentine neon tube 42, which prevents lateral disbursement of light into areas of other segments which are in an unlit condition. The light from each tube segment 40 is thus directed forwardly out of the display through the lens 80. The segment 40*a* comprises a similar boxlike structure 40*b* in a square shape, holding the eight parallel portions 43*a*. The pan 45 with the side walls 48, as well as the similar boxlike structure 40*b* for the square segment 40*a*, concentrate light from the tubes 42, 43 in a precise selected rectangular shape and project the light forwardly.

The neon segments 40, 40*a* thus provide intensified shaped figures, confined by the pan 45 with the shielding side walls 48, or the boxlike structure 40*b*. The four parallel spans 42*a* provide more visible width to the segments 40 making the module 20 more visible at night or during precipitation and at greater distances than standard single span displays. Similarly the eight parallel portions 43*a* provide more visibility to the square segment 40*a*, making the alternate module 26 more visible at night or during precipitation and at greater distances.

The present invention provides a modular design which allows for easy replacement of defective modules or to modify the overall configuration of the display. To replace a module, a maintenance person would remove the lens 80, unbolt the module 20, 26 from the rails 50, 54, disconnect the high voltage plug 74 and reinstall, in a reverse procedure, a replacement display 20, 26. The display 20, 26 can be removed to a shop for repair, or to a storage location for later reuse, the reinstallation operation minimizing down time of the neon sign 10.

Figure 4:
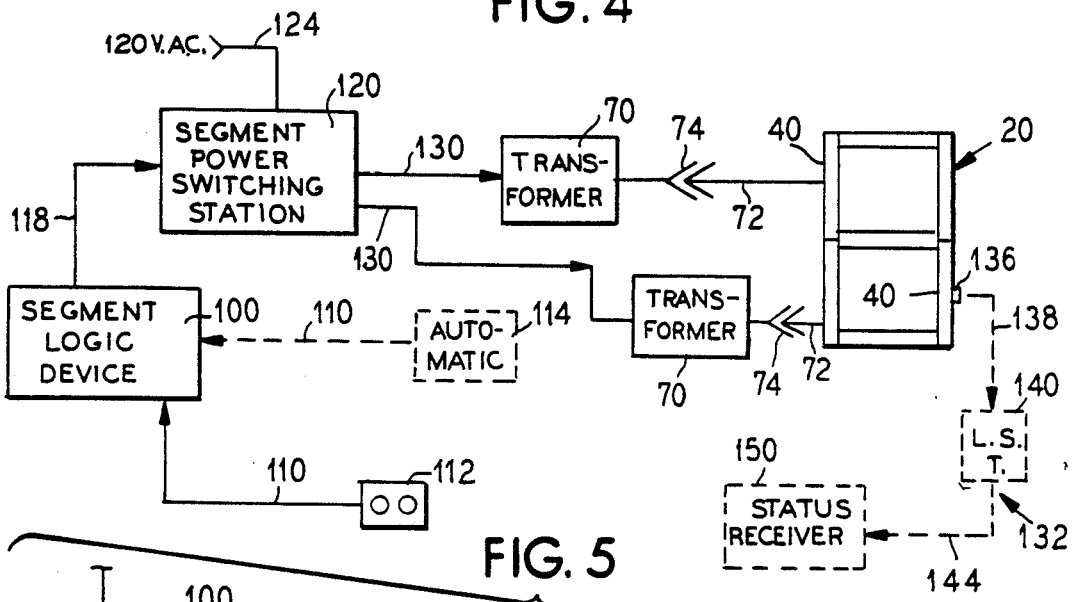
FIG. 4 is a schematic block diagram of a segment selection arrangement.

FIG. 4 shows a schematic block diagram for selectively energizing neon-tube segments 40 of a module 20; a similar method can also be used for alternate module 26. A segment logic device 100 transforms signals received via signal conduit 110 from an external input. The segment logic device 100 which can be an electronic or electric device, converts the input signal to an appropriate electrical output signal. A manually selected input signal can be communicated through conduit 110 by a manual station 112. Such a manual station 112 is appropriate for changing the segment selection periodically. The manual station 112 can be a keyboard where the operator types in the desired sign message. Alternatively, an external input can be an automatic signal 114 such as a clock device or a temperature reading device. Thus, a signal communicated from the automatic device 114 can be the time of day or ambient temperature.

The segment logic device 100 communicates the electric signal through electrical cables 118 to a segment power switching station 120. The segment power switching station 120 is fed by a power source such as a 120 VAC supply shown at 124. The segment power switching station 120 thereupon selectively communicates electrical power via power cables 130 to appropriate transformers 70. This can be accomplished by the use of electrical relays or other such means. Thereupon the transformers 70 supply a high-voltage power supply through cables 72 and disconnect switches 74 to the selected segments 40 of the module 20. The selected segments would thereupon be charged to display a chosen message.

An optional feedback apparatus 132 is shown. The feedback apparatus 132 provides to an operator information regarding operating status of the segments 40. A light or current sensing device 136 senses the on/off status of the segment 40, transmits a signal 138 to a light or current sensing transmitter 140 which in turn transmits, through a transmitting means 144, a signal to a status receiver 150. The transmitting means 144 can be a radio signal, or a cable system, or any other type of appropriate communication system. The status receiver 150 can be a CRT screen or any other appropriate means for displaying information concerning the status of a multitude of segments.

Figure 5:
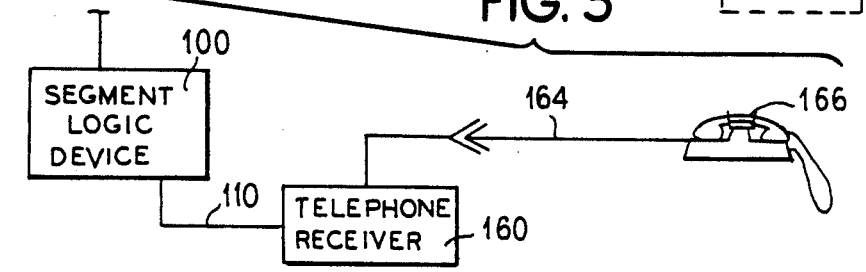
FIG. 5 is a schematic block diagram of an alternate input to the schematic block diagram shown in FIG. 4.

FIG. 5 shows an alternate means of inputting, the segment selection information into the segment logic device 100. In this arrangement a telephone receiver 160 receives a telephone signal via communication means 164 from a telephone 166. The communication means 164 can be an ordinary telephone line. Optionally, the telephone 166 can be of a cellular type with the telephone receiver 160 receiving a cellular phone signal.

Figure 6:
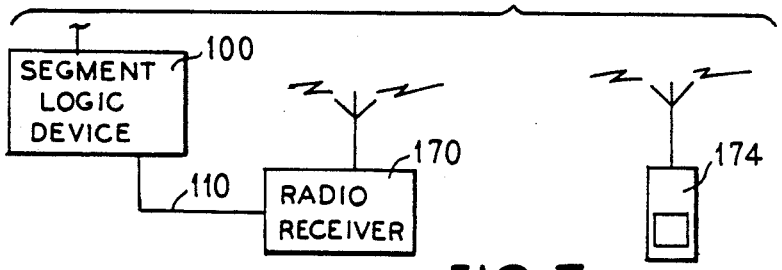
FIG. 6 is a schematic block diagram of a second alternate input to the segment selection arrangement shown in FIG. 4.

FIG. 6 shows an additional means of communicating a segment selection to the segment logic device 100. A radio receiver 170 receives a radio signal from a radio transmitter 174. This configuration is most useful where a plurality of neon signs can receive a identical segment selection input simultaneously within the range of the radio transmitter 174. Also, a more sophisticated signal could be transmitted to discriminate between signs, transmitting different display information to different signs.

Figure 7:
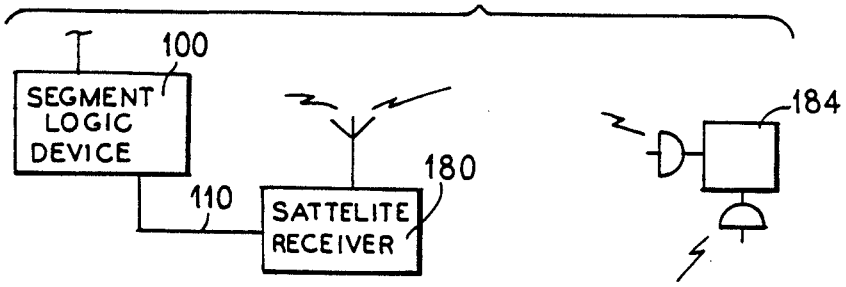
FIG. 7 is a schematic block diagram of a third alternate input to the segment selection arrangement shown in FIG. 4.

FIG. 7 shows an additional means of inputting a segment selection into the segment logic device 100. In this arrangement a satellite receiver 180 communicates the selection through conduit 110 to the segment logic device 100. The satellite receiver 180 receives a signal from a satellite 184. This arrangement, similar to the arrangement shown in FIG. 6, is advantageous for inputting a segment selection to a neon sign located remote from the operator or for inputting a segment selection to a multitude of signs.

Although modifications and changes may be suggested by those skilled in the art, it is the intention of the inventor to embody within the patent warranted hereon all changes and modifications as reasonably and properly come within the scope of his contribution to the art.

I claim as my invention:

1. A neon sign comprising:

at least one module, said module comprising a panel having mounted thereon a plurality of serpentine neon tube segments arranged in a pattern, said neon tube segments selectively electrically charged for displaying an alpha-numeric character, and means for energizing each segment arranged in said pattern to alternately form a portion of at least two alpha-numeric characters;

a plurality of power source connections for individually providing electric power to charge selected ones of said neon tube segments; and a housing, carrying said power source connections and having means for removably mounting said panel to said housing.

2. A neon sign according to claim 1, wherein said neon tube segments each comprise a serpentine shaped neon tube formed with lateral parallel rows, said rows having equal length, said tube being continuous from a first end to a second end.

3. A neon sign according to claim 2 wherein said tube comprises at least four parallel rows.

4. A neon sign according to claim 2 wherein said neon tube segments further comprise a shielding pan between said tube and said panel, said pan including opaque side walls thus forming a shallow open box wherein resides said tube, said shallow open box defining a desired visible shape wherein light from said tube is concentrated and forwardly directed.

5. A neon sign according to claim 1, wherein said housing comprises a back plate, located behind said module, said power source connections being mounted to said back plate and accessible behind said module.

6. A neon sign according to claim 5, wherein each said module is secured to said housing by removable fasteners, said module removably attached and thereafter removable from a front side of said housing.

7. A neon sign according to claim 1, wherein said housing comprises an enclosure providing weather protection for said modules and power source connections.

8. A neon sign according to claim 1, wherein said power source connections comprise transformers which communicate electric power to said segments via power cables with disconnect plugs.

9. A neon sign according to claim 1, wherein said housing provides weather protection for said modules; and said neon sign further comprises a lens covering said modules, said lens allowing said neon segments to communicate light through said lens but preventing weather and vandalism from affecting said neon segments.

10. A neon sign according to claim 1, wherein said plurality of serpentine neon tube segments are identically sized and configured.

11. A neon sign comprising:

a plurality of individual modules, each of said plurality of modules comprising a panel on which is mounted a plurality of neon segments arranged in a pattern, the same said pattern repeated on all of said plurality of modules, each said neon segment comprising a continuous neon tube laterally coiled in a serpentine fashion providing a plurality of parallel rows closely spaced apart and forming a portion of a plurality of selectable alpha-numeric characters;

a source of selectable alpha-numeric characters;

a source of electric power for individually charging selected neon segments;

a housing providing a structure to mount said modules in a position for displaying a message.

12. A neon sign as claimed in claim 11, wherein each said module further comprises a shielding pan having upstanding opaque side walls, said shielding pan located between said panel and said neon tube, said side walls laterally surrounding said neon tube, said shielding pan confining light from said neon tube in a desired area and directing the light away from said panel.

13. A neon sign as claimed in claim 11, wherein said neon tube is coiled in at least four parallel rows.

14. A neon sign as claimed in claim 11, wherein said pattern comprises a figure 8 pattern.

15. A neon sign as claimed in claim 11, wherein said source of electric power comprises an outside source of electric power feeding a plurality of transformers, each said transformer communicating power to one neon segment.

16. A neon sign as claimed in claim 15, wherein said housing comprises an enclosure providing a back plate which mounts said transformers, and a lens which covers the neon segments on a side opposite said panel, said lens passing light therethrough from said neon tubes and protecting said neon tubes from outside disturbances.

17. A neon sign as claimed in claim 16, wherein said housing further comprises two horizontal mounting rails, and said modules are mounted to said rails by removable fasteners which secure said panels to said rails.

18. A neon sign as claimed in claim 16, wherein said panels are removably attached, and thereafter are removable, from a front side of said housing.

19. A neon sign as claimed in claim 11, said sign further comprising a segment logic device which controls said source of electric power to selectively charge selected neon segments, said segment logic device receiving a display instruction from an automatic signal from an outside source.

20. A neon sign as claimed in claim 11, said sign further comprising a segment logic device which controls said source of electric power to selectively charge selected neon segments, said segment logic device receiving a display instruction from a telephone system.

21. A neon sign as claimed in claim 11, said sign further comprising a segment logic device and a receiver, said segment logic device controls said source of electric power to selectively charge selected neon segments, said segment logic device receiving a display instruction from said receiver, said receiver receiving a selection input signal from a remote transmitter, via a wireless signal.

22. A neon sign as claimed in claim 11, wherein said neon sign further comprises a feedback apparatus, said feedback apparatus comprising a sensor transmitting a signal to status receiver at a remote location.

23. A neon sign as claimed in claim 11 wherein said neon segments are identically sized and configured.

24. A neon sign comprising:

a plurality of individual modules, each said module comprising a panel on which is mounted a plurality of pans, each pan containing a neon segment, said pans being arranged in a seven segment figure "8" pattern wherein each neon segment forms a portion of an alpha-numeric character, each said neon segment comprising a continuous neon tube laterally coiled in a serpentine fashion providing at least four equal length parallel rows closely spaced apart;

a source of electric power for individually charging selected neon segments comprising an individual transformer for each neon segment;

a controller for selectively providing power to said individual transformers to selectively charge individual neon segments to display at least one alpha-numeric character per module;

a housing providing a structure to mount said modules in a position for displaying a message, each said module attached individually to said structure by removable fasteners accessible from a front of said housing.

25. A neon sign comprising:

a plurality of individual modules, each said module comprising a panel on which is mounted a plurality of pans, each pan containing a neon segment, said pans being arranged in a pattern such that each neon segment forms a portion of an alpha-numeric character, each said neon segment comprising a continuous neon tube laterally coiled in a serpentine fashion providing a plurality of parallel rows closely spaced apart;

a source of electric power for individually charging selected neon segments;

a housing providing a structure to mount said modules in a position for displaying a message.

* * * * *